US005782437A

United States Patent [19]

Irie et al.

[11] Patent Number: 5,782,437

[45] Date of Patent: Jul. 21, 1998

[54] SPRING RAIL FROG HAVING BENDABLE RAIL WITH MODIFIED CROSS-SECTION

[75] Inventors: Takaaki Irie; Katunari Konishi, both of Himeji, Japan

[73] Assignee: Yamato Kogyo Co., Ltd., Himeji, Japan

[21] Appl. No.: 755,854

[22] Filed: Dec. 2, 1996

[51] Int. Cl.[6] ..... E01B 7/14

[52] U.S. Cl. ..... 246/276; 246/391; 246/468

[58] Field of Search ..... 246/274, 276, 246/382, 389, 391, 454, 468, 472

[56] References Cited

U.S. PATENT DOCUMENTS

| | | | |
|---|---|---|---|
| 217,536 | 7/1879 | Jackson | 246/276 |
| 338,177 | 3/1886 | Lovell | 246/276 |
| 654,039 | 7/1900 | Wharton, Jr. | 246/276 |
| 790,994 | 5/1905 | Anderson | 246/276 |
| 2,036,198 | 4/1936 | Cooper et al. | 246/276 |
| 4,624,428 | 11/1986 | Frank | 246/276 |
| 5,544,848 | 8/1996 | Kuhn et al. | 246/468 |
| 5,618,013 | 4/1997 | Mugg | 246/472 |

FOREIGN PATENT DOCUMENTS

| | | | |
|---|---|---|---|
| 3743368 | 7/1989 | Germany | 246/382 |

*Primary Examiner*—S. Joseph Morano
*Attorney, Agent, or Firm*—Smith Patent Office

[57] ABSTRACT

A spring rail frog is disclosed that includes a movable wing rail, a fixed wing rail and a nose rail. The movable wing rail is provided with a bendable portion and a non-bendable portion. The bendable portion can include any or all of a reduced width base portion, a reduced width head portion and an increased width web portion. The height of the movable wing rail can also be smaller in height than the height of the nose rail. A fixing plate can also be provided between a base plate and the movable wing rail to adjust the relative height of the movable wing rail and the nose rail.

17 Claims, 10 Drawing Sheets

SPRING RAIL FROG HAVING BENDABLE RAIL WITH MODIFIED CROSS-SECTION

BACKGROUND OF THE INVENTION

1. Field of the Invention

The present invention relates to a spring rail frog or rail intersection used in railroad track equipment. The spring rail frog assists in transferring the wheels of the train from one track to another track.

2. Description of the Related Art

When a train is to be diverted from one track to another, a turnout is installed, which is essentially a curve connecting two parallel or diverging tracks. This curve, however, is composed of three principal parts: (1) a switch, consisting of two movable rails to direct the train onto one track or the other, as desired; (2) a frog to allow the wheel flanges to pass the intersection of the rails; and (3) rails, known as lead rails, connecting the frog with the switch rails. The frog is the part where the curved rail for the diverging line crosses the straight rail for the straight ahead move.

There are many different types of frogs including rigid frogs with no moving parts and movable wing frogs that have one or two of the wing rails that can move outwardly to provide a flangeway for the wheel flange. Movable wing frogs also have different types of frogs. The spring rail frog is a movable wing frog where one of the wing rails moves to provide the flangeway.

When two running rails intersect, a spring rail frog allows the wheel flanges to transfer from one rail to another rail.

Spring rail frogs have been known for a very long time. The Weir Frog Company catalog from 1898–9 details many different types of spring rail frogs.

U.S. Pat. No. 2,036,198 discloses a spring rail frog that includes the usual frog point and fixed wing rail secured to the branch line rail and a spring pressed wing rail secured to the main line rail. The spring pressed wing rail is normally held against the frog point to provide a continuous supporting surface for the treads of the wheels running along the main line. This spring rail frog allows the wheels of the branch line trains to automatically open the flangeway between the spring pressed wing rail and the frog point. A dash pot arrangement is provided for automatically controlling the lateral movement of the spring wing rail to prevent its rapid return from an open to a closed position between successive sets of wheels on a train. This invention is directed at eliminating the undesirable action commonly known as slapping back. However, there is no provision in this reference for accomplishing a smoother transfer of each wheel by shortening the bending region of the spring rail or changing the height of the spring rail relative to the nose rail.

U.S. Pat. No. 4,624,428 discloses another type of spring rail frog. This frog includes a spring wing rail having a first position where its free end contacts the long point rail and a second position where the free end is spaced from the long point rail to provide a flangeway therebetween. The spring wing rail is rigidly fixed at a point intermediate the free end and a closure rail engaging end so as to move to allow the spring wing rail to move to the second position when it is stressed by a lateral force applied to it by the flange of a rail car wheel traversing the flangeway. As the spring wing rail is moved to the second position by this force, the spring wing rail is bent along a significant length of the rail in a cantilevered fashion. This bending zone extends from approximately the spacer block to the nose rail.

While these two patents disclose techniques for transferring train wheels from one rail to another using spring rail frogs, there is still a need to improve the smoothness of the transfer of the train wheels. In part this desire for improved smoothness in transfer is because the bending zone of these references is quite large and allows a significant gap to be generated between the spring wing rail and the nose rail. This in turn results in the wheels running on the crossing area for a longer time thereby decreasing the smoothness of transfer.

Also, these references do not allow any adjustment in the height of the spring wing rail relative to the nose rail so as to improve the smoothness of the transfer of wheels on the rails.

SUMMARY OF THE INVENTION

It is an object of the present invention to provide a spring rail frog that allows a smooth transfer of the train wheels between tracks.

It is a further object of the present invention to improve the smoothness of transfer by adjusting the width of the spring or movable wing rail in a selected portion of the rail.

It is still a further object of the present invention to improve the smoothness of wheel transfer by adjusting the height and upper surface contour of the movable wing rail.

It is another object of the present invention to provide a movable wing rail that has a shorter bending region than previous rails.

It is still another object of the present invention to provide a movable wing rail that can be connected to a straight lead rail using a strong attachment.

The aforesaid objects of the invention are achieved by providing a spring rail frog that includes a movable wing rail, a fixed wing rail and a nose rail. The movable wing rail is provided with a relatively short bendable portion and a non-bendable portion. The bendable portion can include any or all of the following: a reduced width base portion, a reduced width head portion and an increased width web portion. This relatively short bendable portion allows the gap between the movable wing rail and the nose rail to be reduced and the rolling of the train running on the crossing area can be prevented as much as possible.

The height of the movable wing rail can also be smaller in height than the height of the nose rail. To accommodate the shorter movable wing rail, a fixing plate can be provided between a base plate and the movable wing rail to adjust the relative height of the movable wing rail and the nose rail. This allows the movable wing rail to be accurately positioned so as to result in a smoother transfer of the wheels between rails.

Additionally, it is disclosed that the grade or gradient on the top surfaces of the wing rail and the nose rail can be shaped so that their surface corresponds to that of the wheel being transferred further improving the smoothness of wheel transfer.

BRIEF DESCRIPTION OF THE DRAWINGS

The above and other objects and features of the present invention will be clearly understood from the following description with respect to the preferred embodiments thereof when considered in conjunction with the accompanying drawings, wherein the same reference numerals have been used to denote the same or similar parts or elements, and in which.

DETAILED DESCRIPTION OF THE PREFERRED EMBODIMENTS

Figure 1:
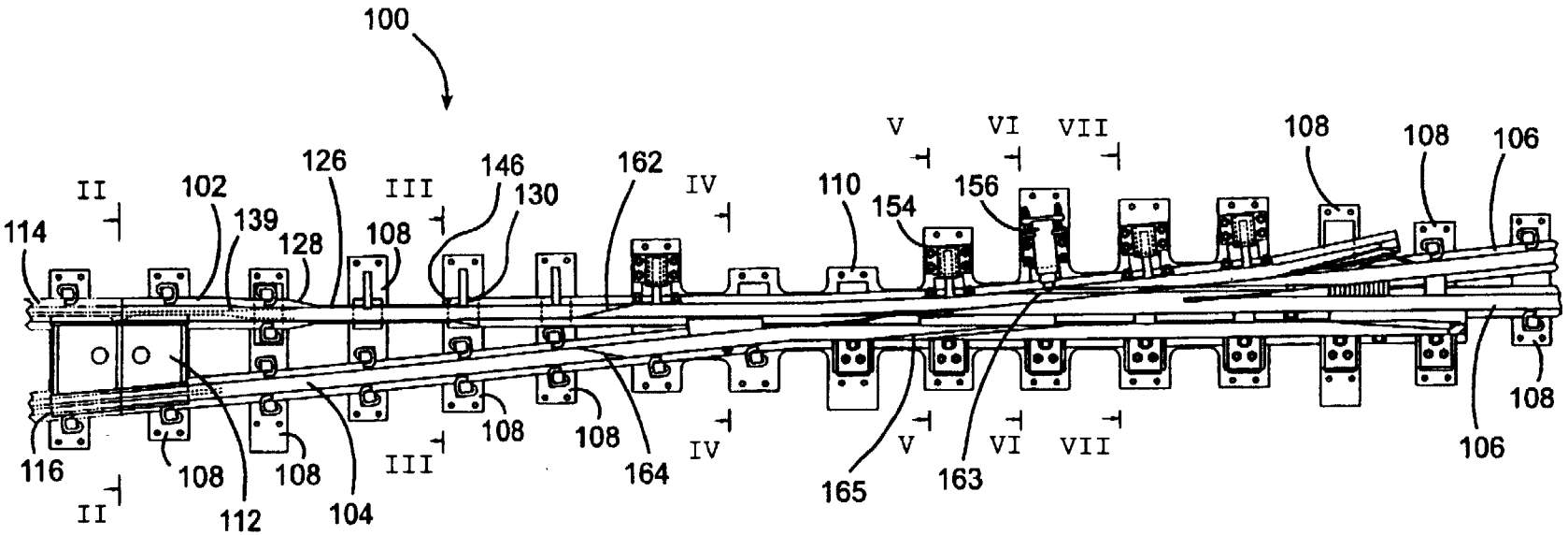
FIG. 1 is an overall top view of the spring rail frog of the present invention.

Referring to the drawings in detail, in particular, to FIGS. 1–7, a movable or spring rail frog 100 is illustrated. The movable rail frog 100 is part of a turnout (not shown) that allows the train wheels to be smoothly transferred between main line rails and branch line rails.

The spring rail frog 100 includes a movable wing rail 102, a rigid wing rail 104 and a V-shaped nose rail 106. The nose rail 106 is made of two separate rails that have been welded together. It is also possible to use two separate rails as is well known in the art.

These rails are mounted on railroad ties 108 and base plate 110. These members provide a level foundation for the frog and maintain the spatial relationship of the elements of the spring rail frog 100.

One end of the movable wing rail 102 and one end of the rigid wing rail 104 are connected to and separated by a spacer block 112. The ends of the movable wing rail 102 and the rigid wing rail 104 are welded to a pair of lead rails 114 and 116, respectively. The lead rails 114 and 116 are in turn connected to the switch rails (not shown) of the turnout. This connection between the movable wing rail 102 and the lead rail 114 as well as the connection between the rigid rail 104 and the lead rail 116 are preferably in the approximate center of opposite sides of the spacer block 112. At the point of connection, the cross sections of the movable wing rail 102 and the lead rail 114 are preferably the same.

Figure 2:
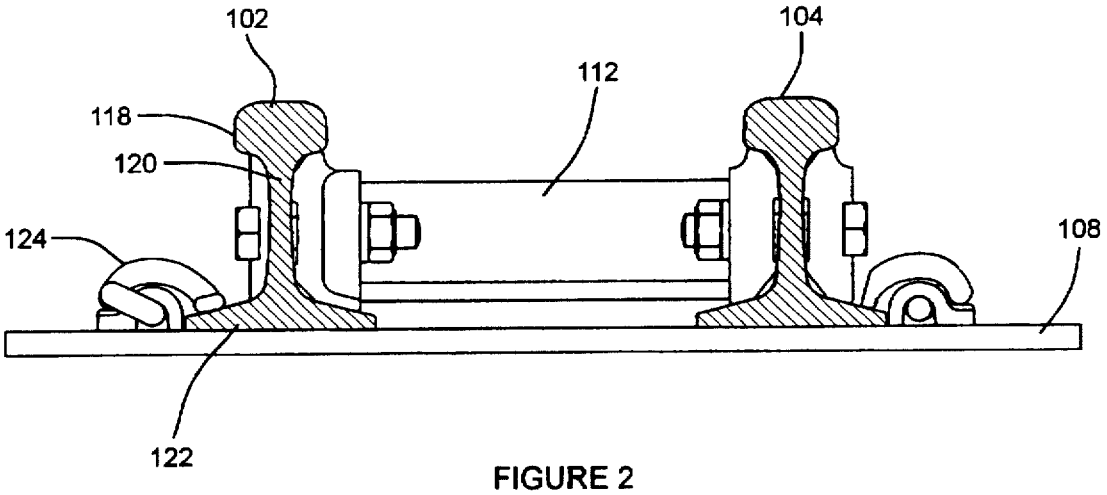
FIG. 2 is a cross section of the spring rail frog taken along line II—II of FIG. 1.

As clearly seen in FIG. 2, the movable wing rail 102 includes a head portion 118, a web portion 120 and a base portion 122. The rigid wing rail 104 and the nose rail 106 also include similar head portions, web portions and base portions.

The movable wing rail 102 is attached to the railroad tie 108 by connection members 124. Similar connection members are shown for attaching the rigid wing rail 104 and the nose rail 106.

The movable wing rail includes a shortened bendable region or portion 126 compared to the prior art. The bendable region 126 extends from where the base portion 128 of the movable wing rail 102 is gradually reduced to where the base portion 130 is gradually increased.

Figure 3:
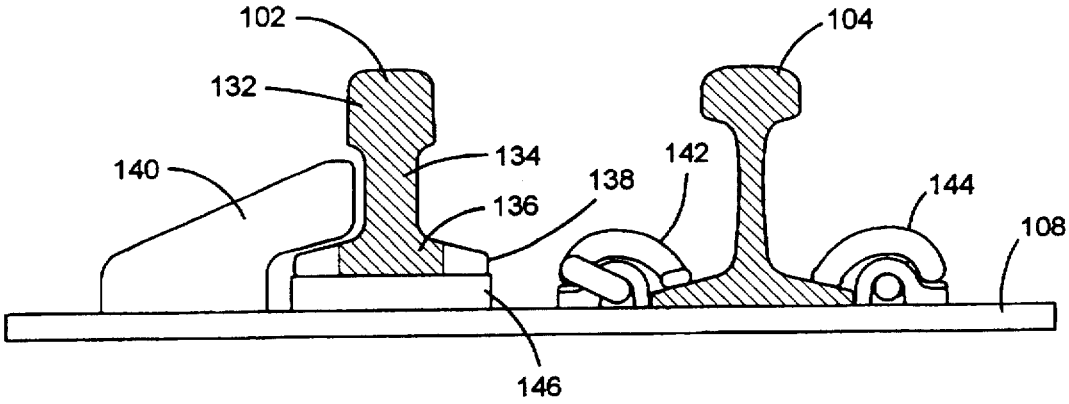
FIG. 3 is a cross section of the spring rail frog taken along line III—III of FIG. 1.

As seen in FIG. 3, the bendable portion 126 can include the following to allow the bendable portion to bend in a specified region along the movable wing rail 102. Specifically, the bendable portion 126 can include a decreased width head portion 132, an increased width web portion 134 to provide added toughness and a decreased width base portion 136. The base portion 136 is shown increased in width to the standard width shown at location 138. The base portion 136 gradually increases in width from the width shown at 136 to the standard width at location 138 as seen by increasing width section 130.

The width of the head portion 118 can also be gradually decreased in a similar manner to the base portion of the movable wing rail 102 so that it results in the width shown at decreased width head portion 132. Also, the width of the head portion can be gradually increased to return to the standard width on the other side of the bendable region 126.

If either or both of the base portion 136 and the head portion 132 have a decreased width then there is a possibility that the movable wing rail 102 has a loss of strength or toughness in this region. To compensate for this loss, it is possible to increase the width of the web portion such as shown in region 134 of FIG. 3. The gradual increasing of the web portion is shown by the dotted lines in location 139 on FIG. 1. It is also possible to decrease the width of the web portion on the other side of the bendable region 126 but it is not required.

The movable wing rail 102 is held and attached to the railroad tie 108 by connection or brace member 140. Similarly, the rigid wing rail is held to the railroad tie 108 by connection members 142 and 144.

FIGS. 1 and 3–7 show that the movable wing rail 102 is mounted on a fixing plate 146. The movable wing rail 102 has a smaller height than the nose rail 106. The height of the fixing plate 146 can be selected to allow proper positioning of the upper surface of the movable wing rail 102 relative to the upper surface of the nose rail 106. The fixing plate 146 can be made of one or two pieces. Also, the fixing plate 146 can be made so that the nose rail 106 can be fixed to the base plate 110 by a lip portion 148 of the fixing plate 146 as seen clearly in FIGS. 5–7. This arrangement results in a very smooth transfer of the wheels between the rails.

Figure 4:
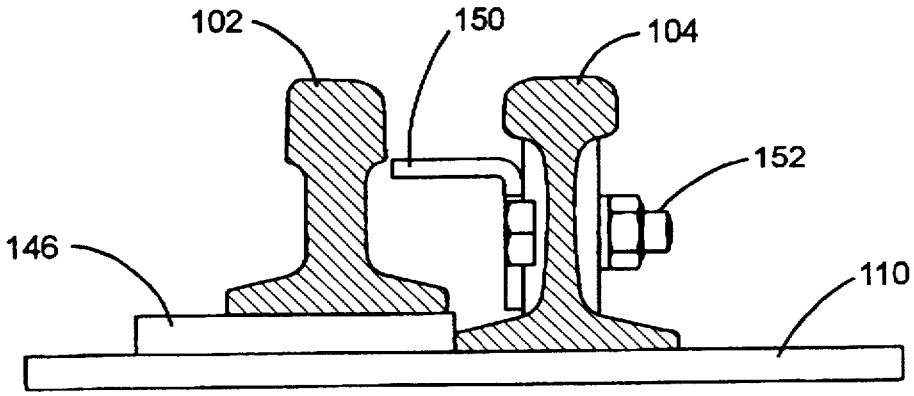
FIG. 4 is a cross section of the spring rail frog taken along line IV—IV of FIG. 1.

FIG. 4 illustrates the movable wing rail 102 located on top of fixing plate 146. The foot guard 150 is attached to the rigid wing rail 104 by a bolt connection 152 and helps prevent a human's foot from falling into between the rigid wing rail 104 and the movable wing rail 102.

Figure 5:
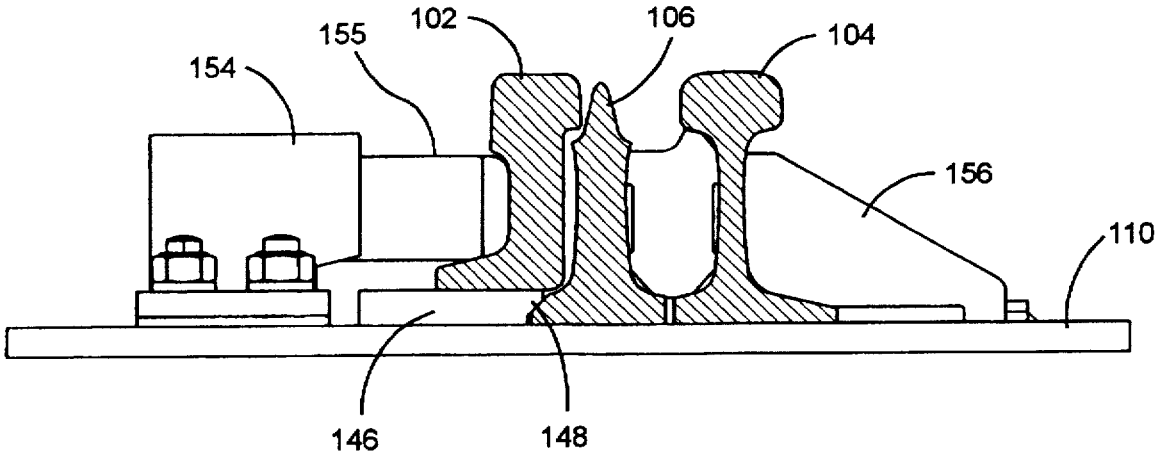
FIG. 5 is a cross section of the spring rail frog taken along line V—V of FIG. 1.

FIG. 5 is a cross section of the spring rail frog taken near the tip of the V-shaped nose rail 106. In this location the movable wing rail 102 is located on the fixing plate 146 and is held in place by hold down 154. Likewise, the rigid wing rail 104 is held in place by brace connection 156. The hold down 154 includes a hold down horn 155 attached to the movable wing rail 102 by a bolt connection. The hold down horn 155 guides the movement of the movable wing rail 102 and prevents the wing rail from being inclined. This is due to the fact that when the movable wing rail 102 moves outwardly, a corner portion of the movable wing rail 102 has a propensity to interfere with a surface of the fixing plate 110 thereby inclining the movable wing rail 102.

Figure 6:
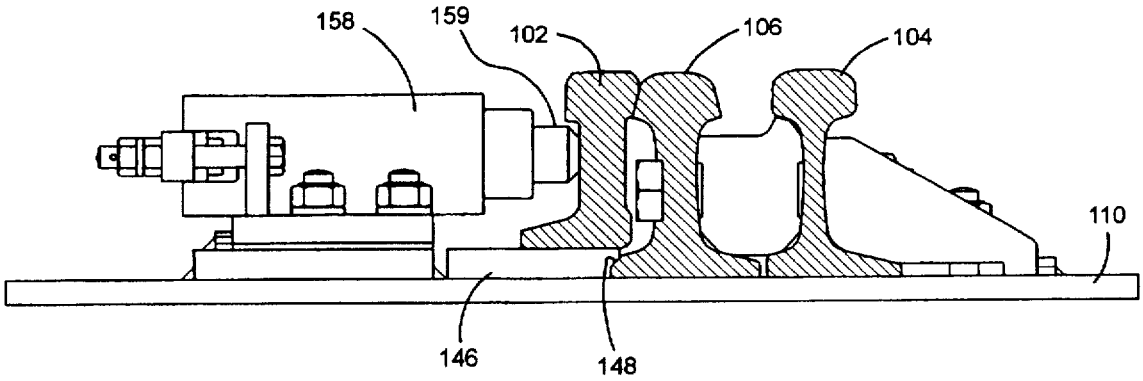
FIG. 6 is a cross section of the spring rail frog taken along line VI—VI of FIG. 1.

FIG. 6 is similar to FIG. 5 except that the movable wing rail 102 is pressed toward the nose rail 106 by a spring box 158. The spring box 158 includes a spring member that presses the movable wing rail 102 toward the nose rail 106 by its end 159.

Figure 7:
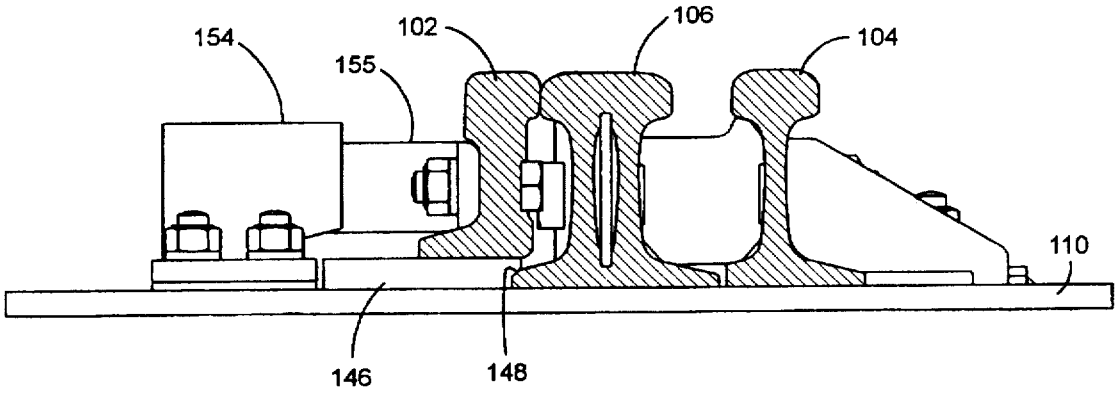
FIG. 7 is a cross section of the spring rail frog taken along line VII—VII of FIG. 1.

FIG. 7 is a cross section of the spring rail frog 100 taken in a location where the two rails of the nose rail 106 are joined at their head and base portions.

Figure 8:
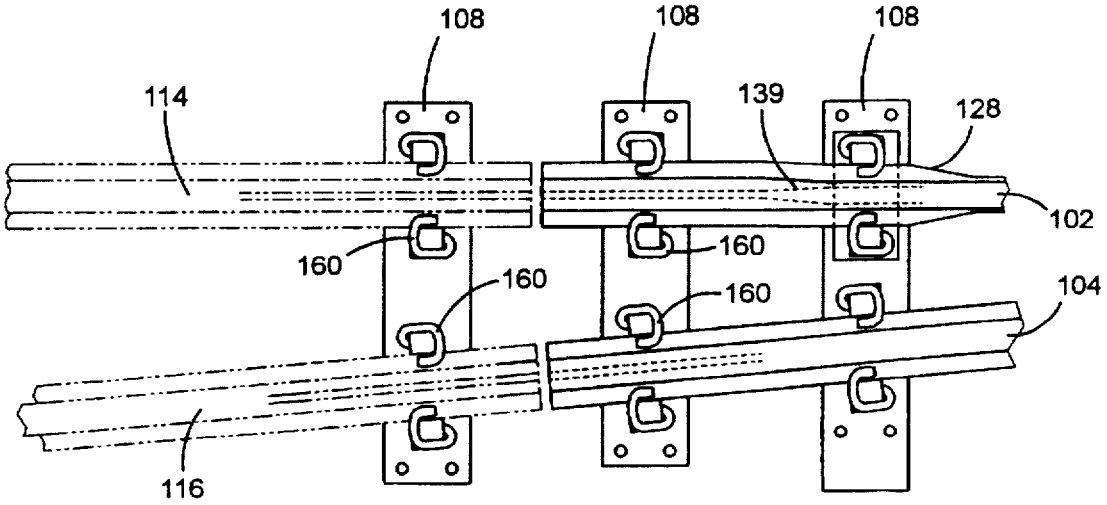
FIG. 8 is a top view of a portion of a spring rail frog in accordance with another embodiment of the invention.

FIG. 8 is a top view illustrating a further embodiment of the connection between the lead rails 114 and 116 and the movable wing rail 102 and the rigid wing rail 104. Instead of using a spacer block, it is possible to properly position these rails by using standard connection members or hold-downs 160 on the railroad ties 108.

It is also possible to gradually incline the upper surfaces of the movable wing rail 102 and the nose rail 106 in a predetermined region of the spring rail frog starting in region 162 of movable wing rail 102 and extending until region 163. The gradual inclination of the upper surfaces is seen in FIG. 6 and is done by cutting the upper surfaces of the movable wing rail 102 and the nose rail 106 so that these surfaces conform to the cross sectional surface of the wheel. This allows the wheel to transfer smoothly over the nose rail 106 and the movable wing rail 102. In the prior art frogs, the upper surfaces are essentially horizontal so that a gap is formed between the wheel surface and the nose rail and also the wheel surface and the movable wing rail. This gap gradually increases so that it is greater above the movable wing rail. It is also possible to gradually incline the upper surfaces of the rigid wing rail 104 in a predetermined region of the spring rail frog starting in region 164 of rigid wing rail 104 and extending until region 165.

While FIG. 1 shows a couple of types of connection members, other types of attachment methods may be used as are well known in the art.

Figure 9:
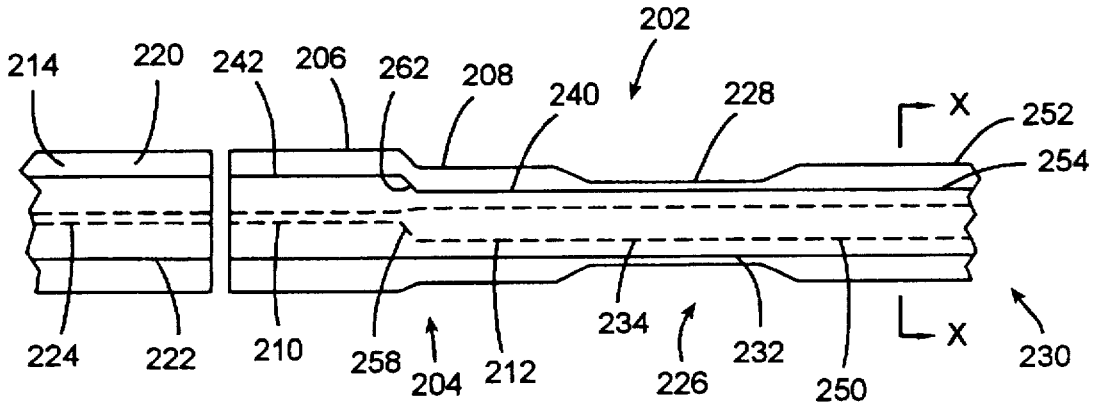
FIG. 9 is a top view of a portion of a lead rail and a portion of the modified movable wing rail according to another embodiment of the present invention.

FIG. 9 discloses a modified movable wing rail 202 similar to wing rail 102 adapted to be welded to a lead rail 214. The lead rail includes a base 216, a head 222 and a web 224 connecting the base 216 to the head 222. The movable wing rail 202 includes a non-bendable regions 204 and 230 and a bendable region 226. The non-bendable region 204 includes different width base sections 206 and 208, different width web portions 210 and 212 and different width head portions 240 and 242.

The bendable portion 226 includes a reduced width base 228, head portion 232 and web portion 234. The reduced width base portion allows the movable wing rail 202 to bend in this region. After the base 228 increases in width on the right side of bendable portion 226, the movable wing rail has another nonbendable region 230.

The non-bendable region 230 includes a base 252, a head 254 and a web portion 250. In this embodiment, the centerline of the non-bendable portion 230, the bendable portion 226 and a part of the non-bendable portion 204 is off set from the centerline of the lead rail 214 and a portion of the non-bendable portion 204 containing web 210. The centerline shift is accommodated by the connection between web portion 210 and web portion 234 as shown at 258. This connection allows a more drastic inclination off the web on the inside side of the movable wing rail 202 than on the outside. Also, the inside section of the head portion is constant along the length of the movable wing rail 202. This allows the wheel flange from the train to run smoothly on the head portions. To accommodate for the change is centerlines between different sections of the movable wing rail 202, the diameter of the head portion changes on the outside edge of the rail as shown at 262.

The cross section of the left side of bendable region 204 needs to have the same cross section as the end of the lead rail 214 so that these ends can be welded together.

Figure 10:
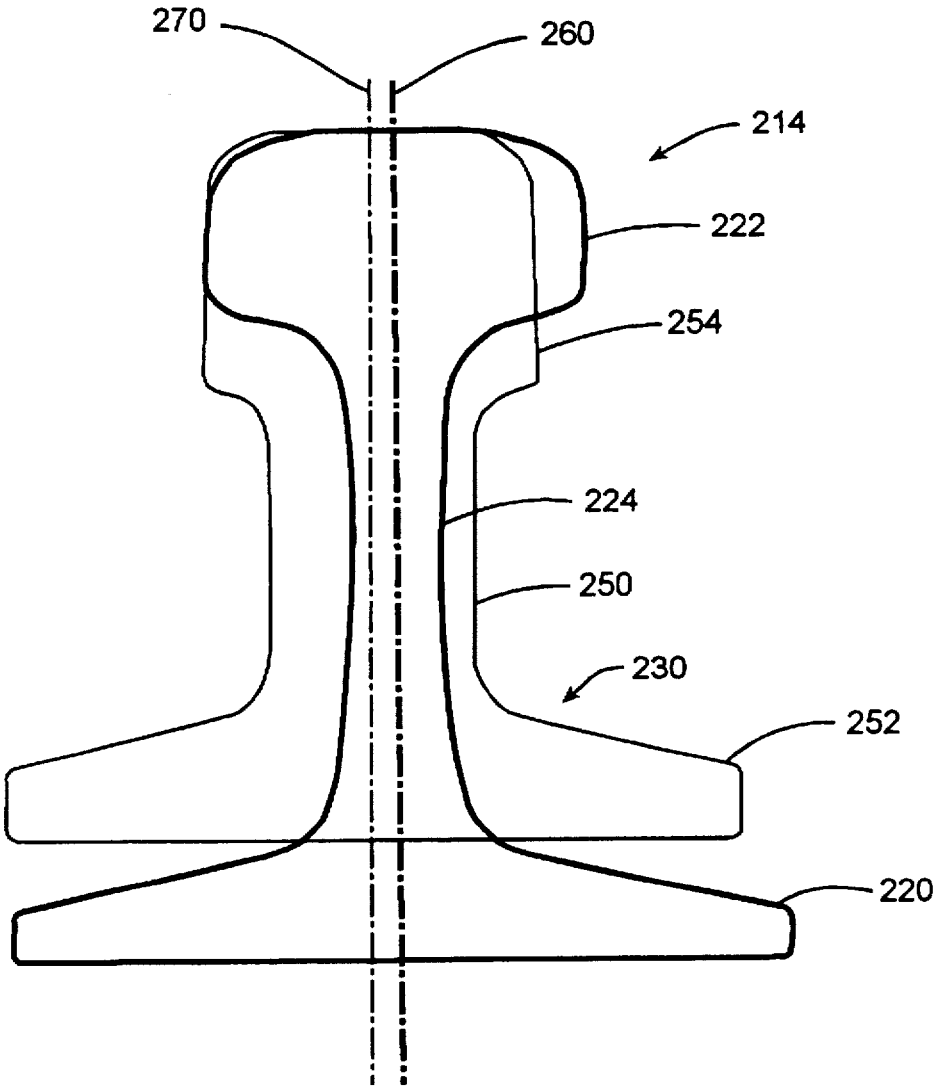
FIG. 10 is a cross sectional view of the movable wing rail taken along line X—X of FIG. 9 overlaid with a cross section of the lead rail to show the difference in width and centerline locations.

The difference in cross section between the right side of the movable wing rail 202 and the lead rail 214 is shown clearly in FIG. 10. This view has been drawn by placing the cross section of the lead rail over the cross section of the movable wing rail 202 taken at line X—X. The difference between the centerline 260 of the lead rail 214 and the centerline 270 of the movable wing rail 202 is also shown in FIG. 10.

It is also possible to eliminate a portion or one side of the base of the movable wing rail 102 or 202 starting in the region adjacent the nose rail and proceeding to the non-fixed end.

It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

What is claimed is:

1. A spring rail frog comprising:

a movable wing rail having a head portion, a web portion and a base portion along its length;

a fixed wing rail; and at least one nose rail;

wherein said movable wing rail has a bendable portion and a non-bendable portion and said base portion of said movable wing rail includes a reduced width base portion so that the bendable portion comprises the reduced width base portion that is reduced in width compared to a width of the base portion of the non-bendable portion.

2. A spring rail frog comprising;

a movable wing rail having a head portion, a web portion and a base portion along its length;

a fixed wing rail; and at least one nose rail;

wherein said movable wing rail has a bendable portion and a non-bendable portion and said head portion of said movable wing rail includes a reduced width head portion so that the bendable portion comprises the reduced width head portion that is reduced in width compared to a width of the head portion of the non-bendable portion.

3. A spring rail frog comprising;

a movable wing rail having a head portion, a web portion and a base portion along its length;

a fixed wing rail; and at least one nose rail;

wherein said movable wing rail has a bendable portion and a non-bendable portion and said web portion of said movable wing rail includes an increased width web portion and said base portion of said movable wing rail includes a reduced width base portion so that the bendable portion comprises the increased width web portion that is increased in width compared to a width of the web portion of the non-bendable portion and the reduced width base portion that is decreased in width compared to a width of the base portion of the non-bendable portion.

4. A spring rail frog as defined in any of claims 1, 2 or 3, further comprising a base plate for receiving said movable wing rail and said nose rail thereon and a fixing plate disposed between said base plate and said movable wing rail.

5. A spring rail frog as defined in claim 1, further comprising a lead rail attached to said movable wing rail and wherein the width of the base portion is gradually increased from the bendable portion to the non-bendable portion.

6. A spring rail frog as defined in claim 2, wherein the width of the head portion is gradually increased from the bendable portion to the non-bendable portion.

7. A spring rail frog as defined in claim 3, further comprising a lead rail attached to said movable wing rail and wherein the width of the web portion in the bendable portion of said movable wing rail is gradually decreased to the same width of a web portion of said lead rail.

8. A spring rail frog as defined in any of claims 1, 2 or 3, further comprising a lead rail attached to one end of said movable wing rail; wherein said lead rail includes a head portion, a web portion and a base portion, such that a cross section of said lead rail is substantially the same as a cross section of one end of said movable wing rail.

9. A spring rail frog as defined in any of claims 1, 2 or 3, further comprising a spacer block, a straight lead rail and a curved lead rail, wherein one side of said spacer block is disposed between said straight lead rail and said movable wing rail and another side of said spacer block is disposed between said curved lead rail and said fixed wing rail.

10. A spring rail frog as defined in claim 9, wherein said straight lead rail is connected to said movable wing rail adjacent to the approximate center of the one side of said spacer block.

11. A spring rail frog as defined in any of claims 1, 2 or 3, further comprising a straight lead rail attached to said movable wing rail and means for fixing one end of said base portion of said movable wing rail adjacent to said straight lead rail.

12. A spring rail frog as defined in any of claims 1, 2 or 3, wherein a portion of said movable wing rail and said nose rail have inclined upper surfaces to conform to the shape of a train wheel.

13. A spring rail frog as defined in any of claims 1, 2 or 3, wherein said at least one nose rail comprises two members welded together in a substantially V-shape.

14. A spring rail frog as defined in claim 1, wherein said reduced width base portion is reduced on both sides of said movable wing rail compared to the width of the base portion of the non-bendable portion.

15. A spring rail frog comprising;

a movable wing rail having a head portion, a web portion and a base portion along its length;

a fixed wing rail; and at least one nose rail disposed between said fixed wing rail and said movable wing rail;

wherein a height of said movable wing rail is smaller than a height of said nose rail, and further comprising a base plate for receiving said movable wing rail and said nose rail thereon and a fixing plate disposed between said base plate and said movable wing rail.

16. A spring rail frog as defined in claim 15, wherein said fixing plate holds said nose rail in place and said fixing plate is attached to said base plate.

17. A spring rail frog comprising:

a movable wing rail a fixed wing rail; and at least one nose rail;

wherein said movable wing rail has a bendable portion and a non-bendable portion, said bendable portion having a head portion, a web portion and a base portion and said non-bendable portion having another head portion, another web portion and another base portion, said base portion of said bendable portion of said movable wing rail including a reduced width base portion relative to said another base portion of said non-bendable portion, said head portion of said bendable portion including a reduced width head portion relative to said another head portion of said non-bendable portion, and said web portion of said bendable portion including an increased width web portion relative to said another web portion of said non-bendable portion.

* * * * *